US009791823B2

(12) United States Patent
Richards et al.

(10) Patent No.: US 9,791,823 B2
(45) Date of Patent: Oct. 17, 2017

(54) CARTRIDGE COMPRISING AN AUTO-DESTRUCT FEATURE

(71) Applicant: HEWLETT-PACKARD DEVELOPMENT COMPANY, L.P., Houston, TX (US)

(72) Inventors: Douglas Robert Richards, Boise, ID (US); Scott K. Hymas, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/608,278

(22) Filed: May 30, 2017

(65) Prior Publication Data

US 2017/0262721 A1 Sep. 14, 2017

Related U.S. Application Data

(63) Continuation of application No. 14/913,976, filed as application No. PCT/US2013/057086 on Aug. 28, 2013, now Pat. No. 9,709,923.

(51) Int. Cl.

| | |
|---|---|
| ***G03G 15/00*** | (2006.01) |
| ***G03G 21/00*** | (2006.01) |
| ***G03G 21/16*** | (2006.01) |
| ***G03G 21/18*** | (2006.01) |
| ***G03G 15/08*** | (2006.01) |

(52) U.S. Cl.

CPC ..... *G03G 21/1657* (2013.01); *G03G 15/0863* (2013.01); *G03G 21/1896* (2013.01)

(58) Field of Classification Search

CPC ..... G03G 15/0863; G03G 21/1657; G03G 21/1875; G03G 21/1892; G03G 21/1896; G03G 2215/0695; G03G 2221/1892; B41J 2/17543; B41J 2/17546; B41J 2/1755

USPC ..... 399/12, 13, 27, 103, 106

See application file for complete search history.

(56) References Cited

U.S. PATENT DOCUMENTS

| | | | |
|---|---|---|---|
| 6,224,276 | B1 | 5/2001 | Funayama et al. |
| 7,196,627 | B2 | 3/2007 | Rommelmann |
| 7,399,047 | B2 | 7/2008 | Ward et al. |
| 8,588,625 | B2 | 11/2013 | Okamoto |
| 8,943,858 | B2 | 2/2015 | Burgess |
| 8,973,949 | B2 | 3/2015 | Lamboy |
| 2002/0085847 | A1 | 7/2002 | Yoshida |
| 2005/0244169 | A1 | 11/2005 | Ono |
| 2006/0065710 | A1 | 3/2006 | Endo et al. |

(Continued)

FOREIGN PATENT DOCUMENTS

| | | |
|---|---|---|
| FR | 2667576 | 4/1992 |
| JP | 2003076230 | 3/2003 |

(Continued)

OTHER PUBLICATIONS

HP Expands Anti-Counterfeit Programme and Chip Patenting (Research Paper); Oct. 31, 2011; https://www.therecycler.com/posts/hp-expands-anti-counterfeit-programme-and-chip-patenting/.

(Continued)

*Primary Examiner* — Robert Beatty

(74) *Attorney, Agent, or Firm* — HP Inc. Patent Department

(57) ABSTRACT

A cartridge including a carrier storing an authenticity verification code readable by a scan device other than a host device and an auto-destruct feature to render the authenticity verification code unreadable at installation.

13 Claims, 8 Drawing Sheets

(56) References Cited

U.S. PATENT DOCUMENTS

| | | | |
|---|---|---|---|
| 2007/0077074 | A1 | 4/2007 | Adkins |
| 2008/0077802 | A1 | 3/2008 | Richardson et al. |
| 2009/0087198 | A1 | 4/2009 | Okamura |
| 2009/0175632 | A1 | 7/2009 | Kim |
| 2011/0137306 | A1 | 6/2011 | Allen |

FOREIGN PATENT DOCUMENTS

| | | |
|---|---|---|
| JP | 2003195698 | 9/2003 |
| JP | 2004059100 | 2/2004 |
| JP | 2008176345 | 7/2008 |
| JP | 2011218880 | 11/2011 |
| KR | 20040006406 | 1/2004 |
| KR | 20070075101 | 7/2007 |

OTHER PUBLICATIONS

Korean Intellectual Property Office; PCT International Search Report and Written Opinion; dated May 22, 2014; PCT Application No. PCT/US2013/057086; 12 pages.

CARTRIDGE COMPRISING AN AUTO-DESTRUCT FEATURE

BACKGROUND

Original authentic cartridges can be defined as being manufactured and sold through channels that are authorized by original equipment manufacturers (OEMs) of the cartridge and corresponding printers. Buyers may associate these cartridges and their contents with a certain level of quality. These authentic cartridges may also fall under certain product warranties provided by the OEMs.

In certain instances, cartridges are refilled, reused or tampered with by unauthorized third parties, for example after the original contents are substantially exhausted. It may be undesirable to associate such modified cartridges with a quality or warranty offered by the OEM.

BRIEF DESCRIPTION OF THE DRAWINGS

For the purpose of illustration, certain examples constructed in accordance with this disclosure will now be described with reference to the accompanying drawings, in which.

DETAILED DESCRIPTION

In the following detailed description, reference is made to the accompanying drawings. The examples in the description and drawings should be considered illustrative and are not intended as limiting to the specific example or element described. Multiple examples can be derived from the following description and drawings through modification, combination or variation of the different elements.

Figure 1:
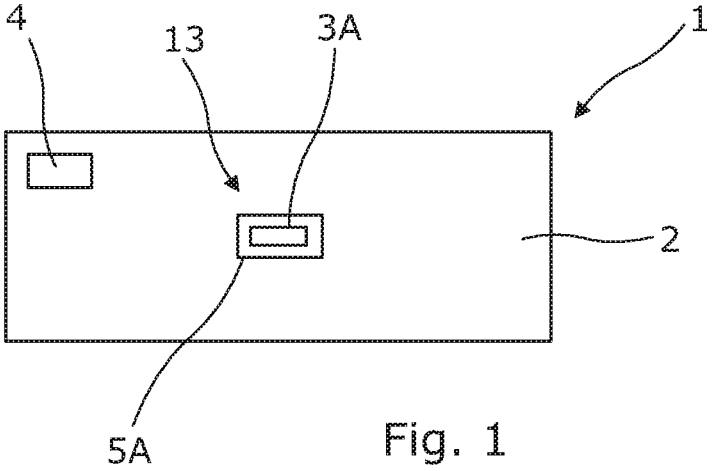
FIG. 1 illustrates a diagram of an example cartridge before installation.

FIG. 1 illustrates a cartridge 1 that is to be installed in a host device. The cartridge 1 is to be replaced in the host device when it is substantially exhausted. The cartridge 1 includes a housing 2. The housing 2 contains an inner reservoir with consumable material that is to be dispensed or deposited with the aid of the host device. In one example the host device is a printer and the cartridge is a print cartridge. In further examples the cartridge is a toner or ink cartridge.

The cartridge 2 includes a carrier 5A that carries an authenticity verification code 3A. The carrier 5A can be disposed on the outside or inside of the cartridge housing 2. In one illustrative example the carrier 5A includes a circuit for storing an authenticity verification code 3A. In another illustrative example the carrier 5A includes a label for having an authenticity verification code 3A imprinted thereon. In further examples the carrier 5A includes a combination of a label and a circuit.

The authenticity verification code 3A allows a third party to verify that the consumable material is from a trusted source by contactless scanning of the authenticity verification code 3A and matching it with a corresponding comparison code. Such comparison code may be stored on a distant computing device other than the printer, in one example on a distant network connected server, for example in a list containing multiple comparison codes. For example, the decoded authenticity verification code 3A corresponds to a unique identity of the product, for example a serial number.

The cartridge 1 includes an auto-destruct feature 13 that renders the authenticity verification code 3A on the carrier 5A permanently unreadable at installation of the cartridge 1 in the host device. For example, the carrier 5A is adapted so that by installing the cartridge 1 in the host device, the authenticity verification code 3A is inherently damaged, as illustrated and explained with reference to FIG. 2. The auto-destruct feature 13 provides that the authenticity verification code 3A can only be verified up until first installation of the cartridge 1. The auto-destruct feature 13 may provide that untrusted third parties cannot reuse such authenticity verification code 3A after exhaustion of the cartridge 1.

For example the authenticity verification code 3A is configured in accordance with at least one predetermined contactless communication standard. Such contactless communication standard may relate to RFID (Radio Frequency Identification), NFC (Near Filed Communication), proximity card-type technology, bar codes, QR codes, and others. In one example a decoded authenticity verification code 3A corresponds with a unique identity number or a unique serial number. In an example the carrier 5A is a read-only type. For example the carrier 5A includes a label having a bar code or QR code imprinted thereon. For example the carrier 5A includes an unpowered NFC tag. In line with the foregoing, the authenticity verification code 3A can be an optically scannable code such as a Quick Response (QR) code, or a non-visible code stored on a non-transitory non-volatile memory circuit having an RFID or NFC interface.

In the illustrated example, the cartridge 1 can include an additional interconnect circuit 4 to communicate with the host device. For example the interconnect circuit 4 includes a non-transitory non-volatile memory circuit that is to be read and/or written by a host device. Example interconnect circuits 4 include an EEPROM circuit or a secure micro controller. The host device is provided with a corresponding interconnect circuit to read the information from the cartridge interconnect circuit 4, and in some examples write information to it. The additional cartridge interconnect circuit 4 may store at least one second authenticity verification code that is to be read by the host device to establish an authenticity of the cartridge 1. The second authenticity verification code may include a unique identifier, for example a product serial number or the like. For example, the second authenticity verification code on the cartridge interconnect circuit 4 is to be matched to at least one corresponding second comparison code stored in a printer or network memory. For example the cartridge interconnect circuit 4 is to remain functional, at least until the cartridge life fully or partly emptied or until the end of life of the cartridge.

In one example the carrier 5A is not to be connected to a host device circuit. For example, the first authenticity verification code 3A is not readable or decodable by the host device, before nor after installation.

Figure 2:
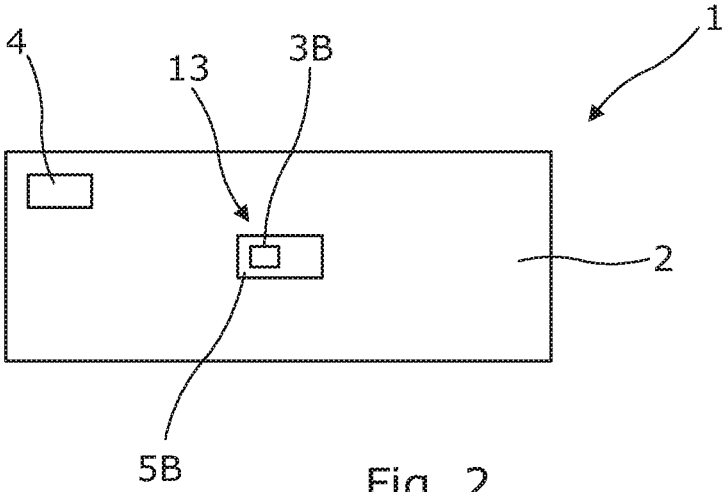
FIG. 2 illustrates a diagram of the example cartridge of FIG. 1 after installation.

In one example, the carrier 5A is designed to allow contactless scanning of the authentication verification code 3A by a third party scan device that is not the host device. Such third party scan device can be a handheld, mobile computing device such as a smart phone or tablet that has a respective scan capability, or a dedicated scan device. For example the capability allows for scanning the authentication verification code 3A according to at least one suitable standard technique including RFID (Radio Frequency Identification), NFC, IR (Infrared), or Optical Scanning techniques such as bar codes, QR codes, etc. Depending on the chosen scan standard, the capability may include an optical sensor, an NFC or RFID transmitter, and a set of respective decoding instructions stored on a scan device memory. In a further example the scan device has a network communication capability to compare the decoded authenticity verification code 3A to a trusted party's list of pre-stored corresponding comparison codes, for example stored on a distant computing device such as a server. In one example the decoded authenticity verification code 3A is to be verified with a corresponding comparison code on an external server FIG. 2 illustrates the cartridge 1 of FIG. 1 after having installed the cartridge 1 in the host device. The auto-destruct feature 13 caused damage to the authenticity verification code 3B. The damaged authenticity verification code cannot be decoded according to the standard scanning technique used to scan the original authenticity verification code 3A (FIG. 1). For example the authenticity verification code 3B is at least partly erased, destroyed, ruptured, covered, concealed, etc. with respect to the original authenticity verification code 3A, during installation. In one example the auto-destruct feature 13 includes a location of the carrier 5A that causes the carrier 5A to contact a corresponding printer part during installation that in turn damages the authenticity verification code 3A, 3B. In different examples the damaging can occur (1) mechanically, for example through rupturing, covering, scratching, erasing, breaking, or (2) electrically or (3) magnetically, for example by applying a voltage or magnetic field. For example said "damaging" excludes a controlled digital write operation to the carrier 5A, 5B to alter the authentication verification code 3A.

Figure 3:
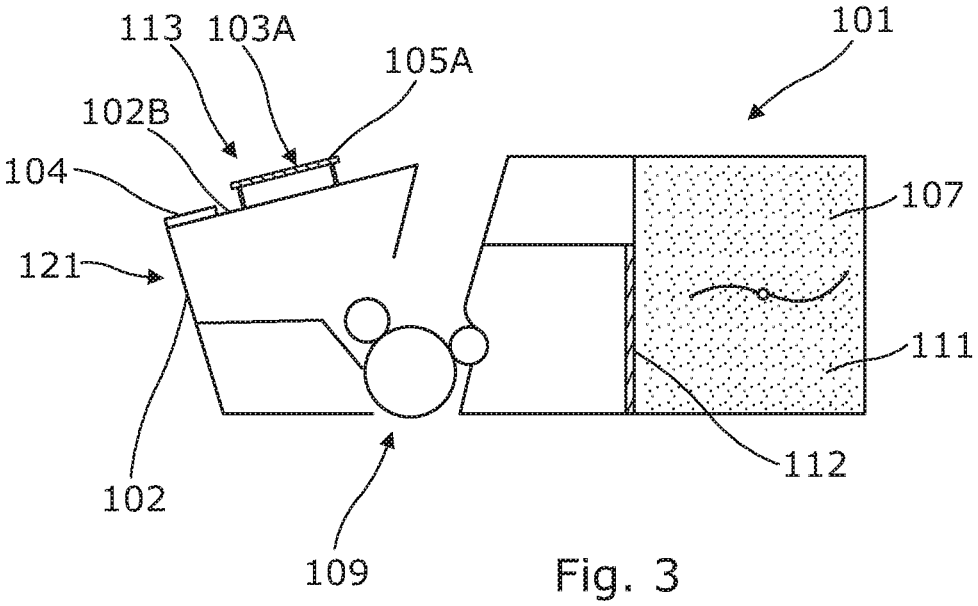
FIG. 3 illustrates a diagram of another example cartridge before installation.

FIG. 3 illustrates an example of a toner cartridge 101 having a housing 102. The cartridge 101 includes a reservoir 107 and a toner transfer assembly 109. The reservoir 107 contains toner particles 111. The cartridge 101 includes a toner dam 112 that extends between the stored toner particles 111 and the transfer assembly 109 so that the toner particles 111 are retained by the toner dam 112. The toner dam 112 is to be removed, automatically or manually, at installation of the cartridge 101 in the printer, to release the toner particles 111. The cartridge 101 includes a cartridge interconnect circuit 104 that is to connect to a corresponding printer interconnect circuit.

A carrier 105A is provided on the outside of a housing wall 102B. The carrier 105A protrudes outwardly from the housing wall 102B. For example the carrier 105A is distanced from the interconnect circuit 104. For example the carrier 105A includes a raised platform. For example the authenticity verification code 103A is imprinted on a label on top of the carrier 105A. For example the carrier 105A is disposed on a wall portion 102B that is close to a front portion 121 of the cartridge 101, the front portion 121 being a portion that is first inserted in the printer at installation. This may avoid that hands are close to the carrier 105A when installing the cartridge 101.

In this example, the auto-destruct feature 113 is defined by the location and protruding shape of the carrier 105A. The carrier 105A is located so that it bumps against a corresponding printer engagement member at installation. For example the carrier 105A and/or authenticity verification code 3A need to be damaged to install the cartridge 101. This provokes damage to the carrier 105A and the authentication verification code 103A. In one example the carrier 105A includes break features to allow for easy disengagement, easy rupture or cutting of the authentication verification code 103A without needing to apply excessive manual force during installation.

Figure 4:
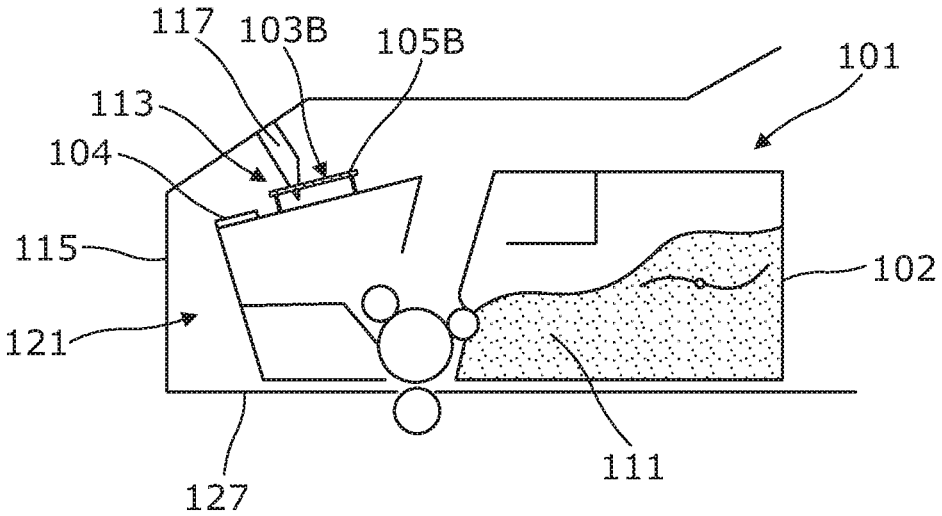
FIG. 4 illustrates a diagram of the example cartridge of FIG. 3 and an example printer, after installation.
Figure 6:
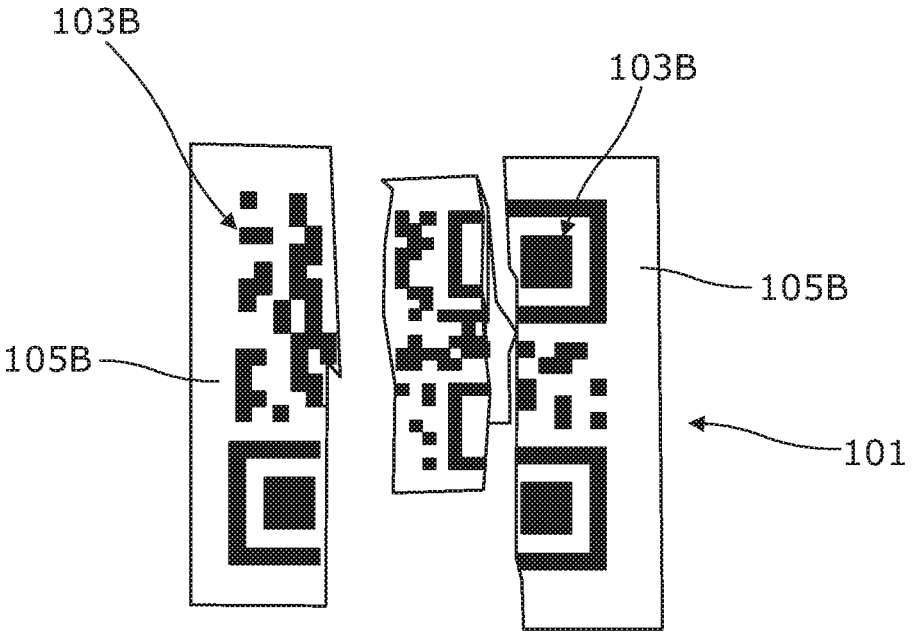
FIG. 6 illustrates the example carrier after installation.

Referring to FIG. 4, the printer 115 may include guide walls 127 and other guide or latch features to insert, guide and latch the cartridge 101 into the printer 115. The printer 115 includes an additional engagement member 117 that is to engage the carrier 105E during installation of the cartridge 101 to damage the authenticity verification code 103B at installation. For example the engagement member 117 includes a protrusion. For example the engagement member 117 includes a knife or pin. In different examples, the engagement member 117 can be mounted to the printer housing, or defined by an integral part of the printer housing. During installation of the cartridge 101 the engagement member 117 protrudes through or against a part of the carrier 105B to damage the authenticity verification code 103B. In the illustrated example of FIG. 4 the carrier 105B and authenticity verification code 103B may be pierced or ruptured, for example as illustrated in FIG. 6.

Figure 5:
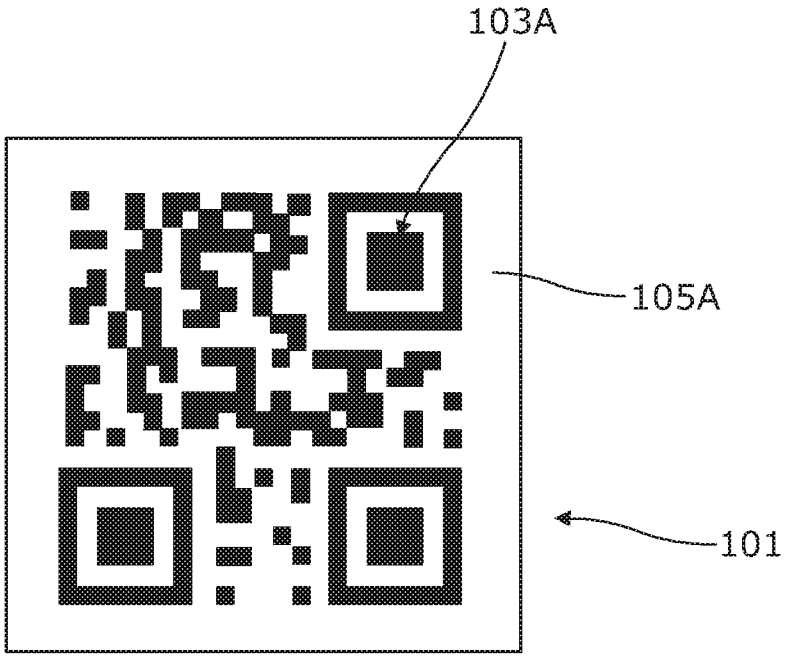
FIG. 5 illustrates an example carrier before installation.

FIG. 5 illustrates an example of a top view of a carrier 105A on a cartridge 101 before installation in a host device. The carrier 105A includes an optical authenticity verification code 103A. In the illustrated example the carrier 105A includes a label with the authenticity verification code 103A imprinted on it in the form of a QR code. In the illustrated condition, the optical authenticity verification code 103A can be read and verified by a third party scanning device such as a smart phone with a QR code scanning capability. FIG. 6 illustrates the same carrier 105E in a different state, after installation. The carrier 105E and the authenticity verification code 103B are damaged by the auto-destruct feature. In the illustrated state, the damaged authenticity verification code 103B may be unreadable or unverifiable by a third party scanning device having a QR code scanning capability.

Figure 7:
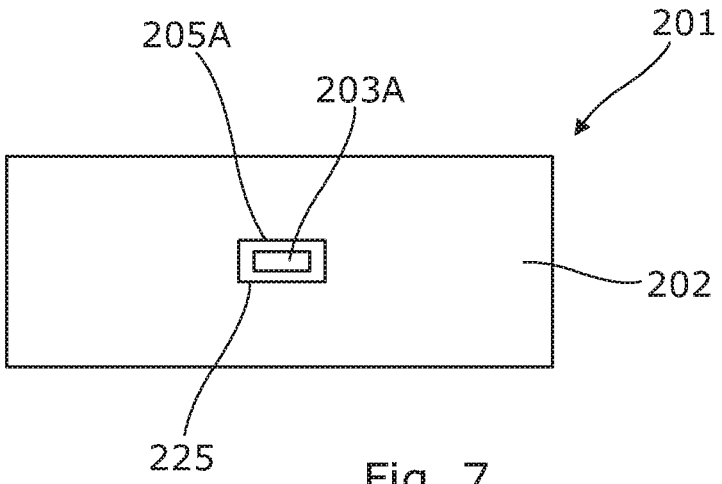
FIG. 7 illustrates a diagram of an example cartridge before installation.

FIG. 7 illustrates an example of a cartridge 201. The cartridge 201 includes a housing 202. In one example the cartridge housing 202 is defined by at least one protective plastic shell used to mount and contain the various cartridge parts. The housing 202 includes a window 225. A carrier 205A is disposed within the housing 202. The carrier 205A includes an authenticity verification code 203A. For example, the carrier 205A can be a platform, a plate or an integral housing part that facilitates mounting or imprinting of the authenticity verification code 203A. In this example, the authenticity verification code 203A includes an optical code to be scanned by a scanning device using a predetermined standard optical scanning technology. In one example the authenticity verification code 203A is a QR code or bar code imprinted on the carrier 205A. The carrier 205A is provided near the window 225 and the authentication verification code 203A faces the window 225 so that the authenticity verification code 203A can be optically scanned from an outside of the housing 202, through the window 225, for example by a smart phone having a respective scanning capability.

The cartridge 201 includes an auto-destruct feature to render the authenticity verification code 203A unreadable at installation. The auto-destruct feature is represented by the location of the carrier 205A and the authentication verification code 203A. Here, the carrier 205A is disposed in a toner travel path to cover the authentication verification code 203A with toner, once toner is released from inside the cartridge 201, for example at a first installation of the cartridge and/or when a toner dam is removed. In addition adhesive can be provided on the carrier 205A to adhere toner particles 211 and better conceal the authenticity verification code 203A. In a further example, the carrier 205 may include a label to better absorb toner particles.

Figure 8:
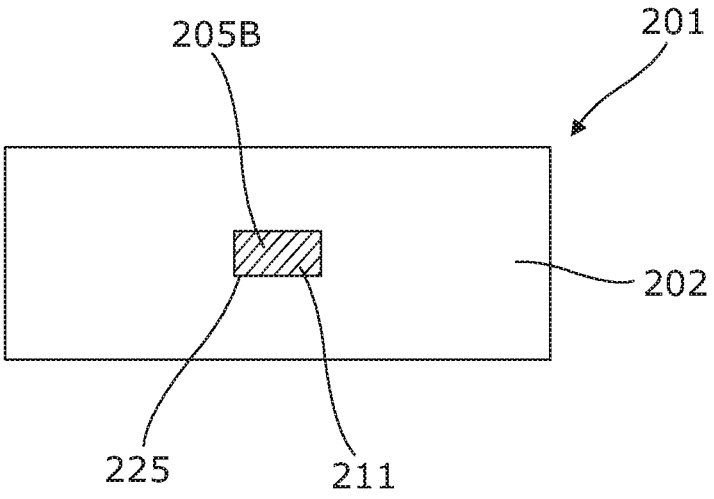
FIG. 8 illustrates a diagram of the example cartridge of FIG. 7 after installation.

FIG. 8 illustrates the example cartridge 201 of FIG. 7 in an installed or substantially exhausted condition. For example the carrier medium 205B is covered with toner 211 after the release of toner 211 in the cartridge 201, rendering the authenticity verification code 203B unreadable. For example the released toner particles 211 adhere to the carrier 205B in a substantially permanent manner.

Figure 9:
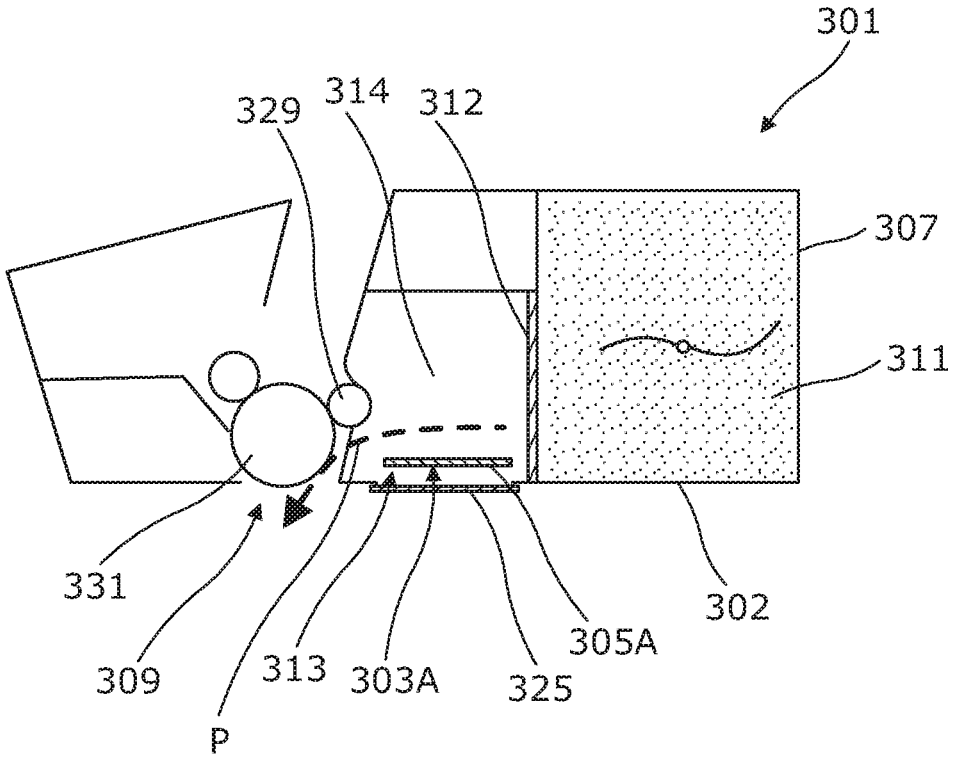
FIG. 9 illustrates a diagram of another example toner cartridge before installation.

FIG. 9 illustrates another example of a toner cartridge 301. The cartridge 301 includes a housing 302. The housing 302 includes a reservoir 307 filled with toner particles 311. The cartridge 301 includes a toner dam 312 to retain the toner particles 311. The cartridge 301 includes a toner transfer assembly 309. The toner transfer assembly 309 includes a developer drum 329 and a photoconductor drum 331. The cartridge 301 includes an intermediate chamber 314 between the sealed toner reservoir 307 and the toner transfer assembly 309. In the illustrated condition, the toner dam 312 retains the toner particles 311 so that the intermediate chamber 314 is empty, that is, without toner. A toner travel path P of the cartridge 301 extends from the reservoir 307 through the toner dam 312, intermediate chamber 314, and along the developer drum 329, photoconductor drum 331 to a media.

The cartridge 301 includes a carrier 305A. An optical authentication verification code 311 imprinted on the carrier 305A. The carrier 305A is disposed in the toner travel path P so that the toner particles 311, once released, adhere to the carrier 305A, concealing the authenticity verification code 303A. The carrier 305A is disposed downstream of the toner dam 312, between the toner reservoir 307 and the toner transfer assembly 309, for example in the intermediate chamber 314. The carrier 305A can include a platform or an integral part of the housing. The carrier 305A can include a label with a print of the authenticity verification code 303A. The authenticity verification code 303A includes a standard machine readable optical code such as a OR code.

The housing 302 includes a window 325 to allow scanning of the authenticity verification code 303A through the window 325. The carrier 305A is disposed near or opposite to the window 325. The authenticity verification code 303A faces the window 325 so that it can be optically scanned through the window 325, from outside the cartridge 301, at least before removal of the toner dam 312. For example, the authenticity verification code 303A is readable by a smart phone having a respective scanning capability.

The cartridge 301 is provided with an auto-destruct feature. In this example the auto-destruct feature 313 is represented by the location of the carrier 305A in the toner travel path P. Once toner is released out of the reservoir 307 it will cover the authenticity verification code 303A with a layer of toner particles, at least partly concealing the authenticity verification code 303A, sufficient to render the authenticity verification code 303A unreadable. For example a suitable adhesive could be applied to the carrier 305A to facilitate toner particles adherence. In an example, the carrier 305A is adapted to absorb toner particles.

Figure 10:
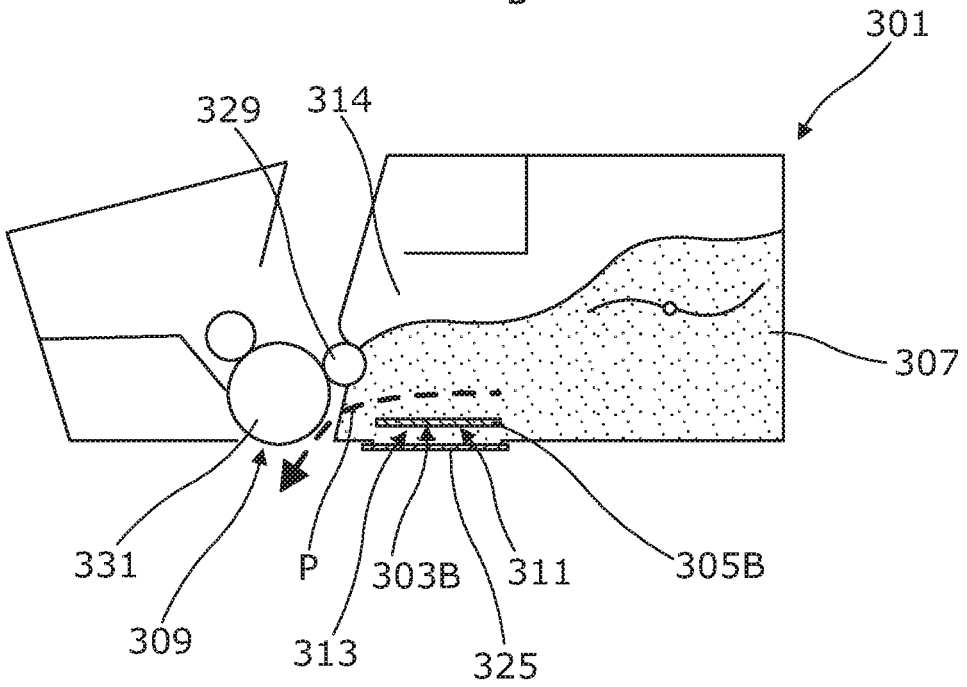
FIG. 10 illustrates a diagram of the example cartridge of FIG. 9 after installation.

FIG. 10 illustrates the example toner cartridge 301 of FIG. 9 in a recently installed condition. The toner dam 312 has been removed to release the toner particles 311, either manually or automatically. The toner particles 311 have traveled over part of the toner travel path P into the intermediate chamber 314 towards the photoconductor drum 331. In the installed condition, the authenticity verification code 303B is covered with toner particles 311 and hence the authenticity verification code 303B is rendered unreadable.

Figure 11:
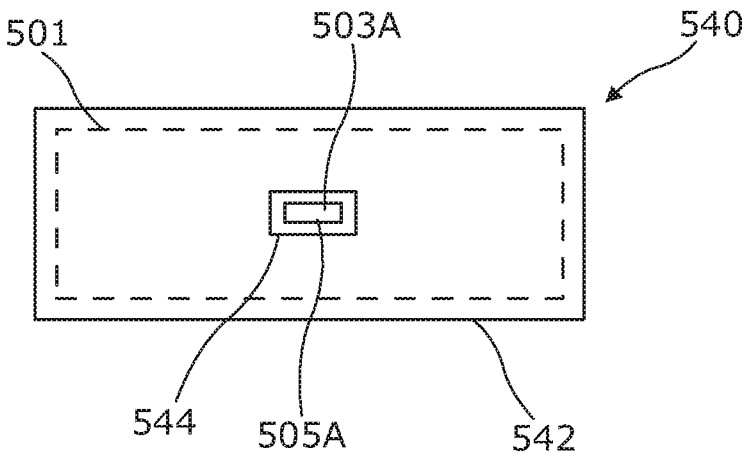
FIG. 11 illustrates a diagram of an example assembly of a packaged cartridge.

FIG. 11 illustrates an assembly 540 of a toner cartridge 501 and packaging 542. The cartridge 501 may be of a similar type as one of FIG. 1, 3, 7 or 9. The packaging 542 may be a carton packaging. The toner cartridge 501 is surrounded by the packaging 542. The packaging 542 includes a window 544. The window 544 may be defined by a cut out through a respective packaging wall. A transparent plastic foil may be provided in the window 544. The toner cartridge 501 includes a carrier 505A and an authenticity verification code 503A. The authenticity verification code 503A may be an optical authenticity verification code 503A. The carrier 505A may be disposed on the outside of the cartridge 501. In one example, the carrier 505A is disposed on the inside of the cartridge 501 and the cartridge includes a window. The cartridge is oriented so that the carrier 505A is disposed opposite to the window 544 and the authenticity verification code 503A faces the window 544. In packaged condition the authenticity verification code 503A can be scanned through the window 544.

Figure 12:
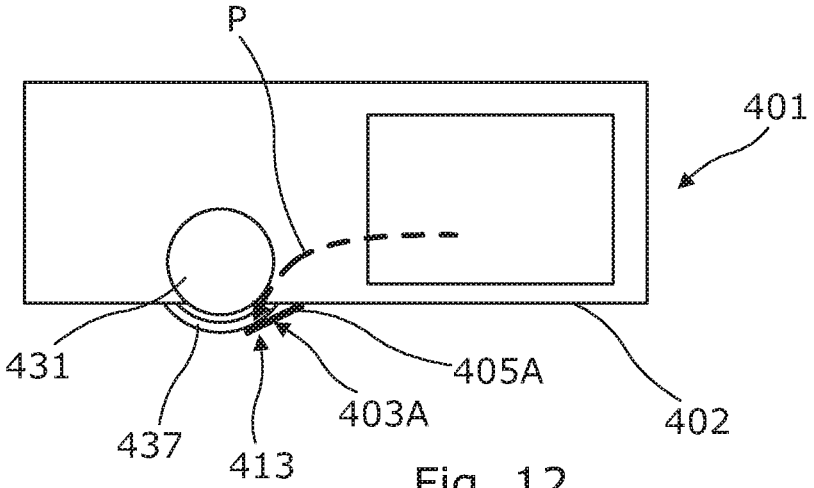
FIG. 12 illustrates a diagram of an example cartridge before installation.
Figure 13:
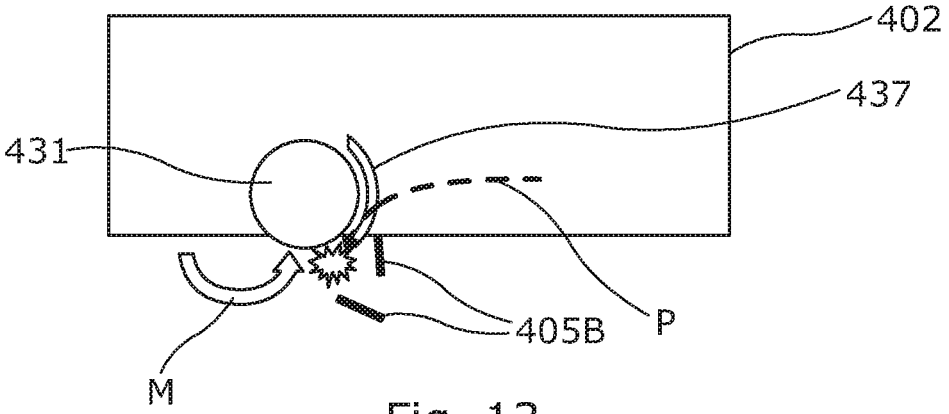
FIG. 13 illustrates a diagram of the example cartridge of FIG. 12 after installation.

FIG. 12 illustrates another example of a toner cartridge 401. The toner cartridge 401 includes a housing 402 and a reservoir. The toner cartridge 401 includes a photoconductor drum 431 for transferring toner. The cartridge 401 includes a moveable or removable drum cover 437 that protects the photoconductor drum 431. The drum cover 437 is to expose the drum 431 at installation in a printer. For example the drum cover 437 is a cover sheet or a drum shutter. For example the drum cover 437 is removable, slideable or hingeable with respect to the housing 402. For example the drum cover 437 is to slide with respect to the housing 402 in a rotating manner M along the photoconductor drum 431, as illustrated in FIGS. 12 and 13. The drum cover 437 is to be manually or automatically moved before or during installation, respectively. In a further example, the drum cover 437 automatically opens by inserting the cartridge 401 in a printer, by engaging a corresponding printer protrusion or notch.

A carrier 405A is attached to the drum cover 437 and the housing 402. One side of the carrier 405A is attached to the drum cover 437 and another side is attached to the housing 402. In the illustrated example the carrier 405A is attached to the outside of the drum cover 437 and housing 402. An authentication verification code 403A is imprinted or stored on the carrier 405A. In one example, the carrier 405A includes a label and the authenticity verification code 403A includes an optical code. For example part of the optical code is imprinted where the label is attached to the drum cover 437 and housing 402. In another example the carrier 405A includes a contactless circuit such as an NFC tag storing the authenticity verification code.

In another example a carrier is attached to the inside of the drum cover 437 and housing 402. For example such carrier includes a contactless circuit, such as an NFC circuit. For example a label is attached to the drum cover 437 and the housing 402 and the circuit is attached the label.

In the example of FIGS. 12 and 13, an auto-destruct feature 413 is provided by the location of the carrier 405A. As illustrated in FIG. 13, the carrier 405B needs to be ruptured to open the drum cover 437 and clear a toner travel path P. Said rupturing renders the authenticity verification code 403B unreadable. In one example, the carrier 405A includes a break line over the authentication verification code 403A to facilitate easy rupture of the carrier 405B and the authentication verification code 403B.

Figure 14:
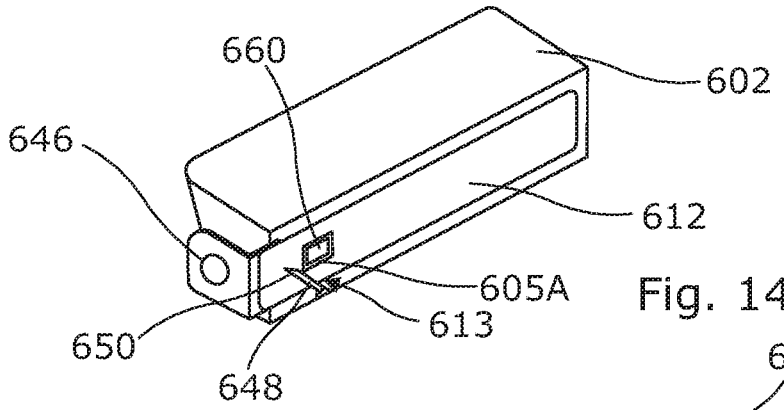
FIG. 14 illustrates a diagram of one half of an example cartridge before installation, in perspective view.

FIG. 14 illustrates one half of a cartridge housing 602, for example in a disassembled or intermediate state of the cartridge. The illustrated cartridge half is sealed by a toner dam 612. The toner dam 612 includes a pull handle 646 to manually pull the toner dam 612 to release toner particles. The toner dam 612 includes an authenticity verification code. A carrier 605A is attached to the toner dam 612. The carrier 605A includes a contactless first circuit 660 such as an NFC tag, for example a passive NFC tag. In one example the carrier 605A includes a label or a circuit that includes the first circuit 660. In another example the carrier 605A is defined by the first circuit 660. The first circuit 660 is to be read by a third party scanning device. The authenticity verification code is to be scanned from outside the cartridge, before the toner dam 612 is removed.

An auto-destroy feature 613 is represented the location of the carrier 605A on the toner dam 612. The carrier 605A is located on the cartridge 601 such that it automatically interferes with a printer-part. Such printer part may include any protrusion suitable to damage the first circuit 660 when removing the toner dam 612.

The knife 648 is disposed opposite to the toner dam 612, so that it damages the first circuit 660 when the toner dam 612 is pulled along the knife 648. For example the knife 648 is disposed opposite to the toner dam 612, for example between the carrier 605A and the pull handle 646, with a cutting edge 650 or point near or against the toner dam 612. The knife 648 is disposed such that once the toner dam 612 is pulled along the knife 648, the first circuit 660 will engage a cutting edge or point of the knife 648. By pulling the toner dam 612 out of the cartridge the first circuit 660 is permanently damaged, enough to render the authenticity verification code unreadable by a scanning device. In one example the first circuit 660 is cut through.

Figure 15:
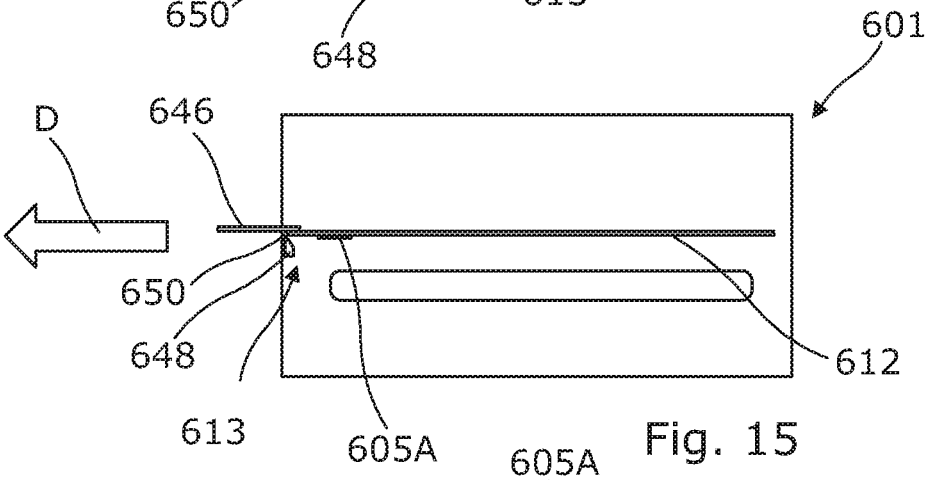
FIG. 15 illustrates a diagram of an example cartridge corresponding to FIG. 14 in cross-sectional top view.
Figure 16:
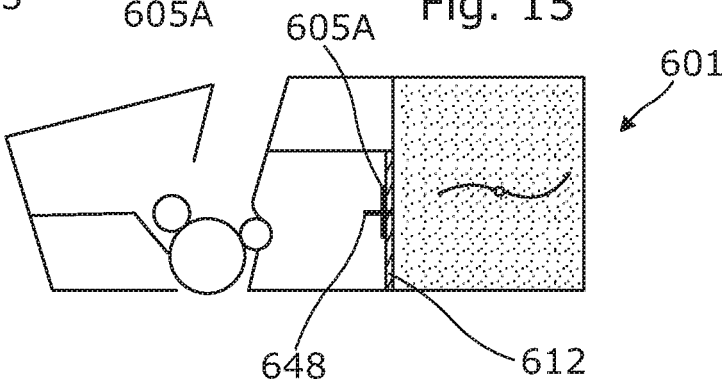
FIG. 16 illustrates a diagram of the example toner cartridge of FIG. 15 in a cross-sectional side view.
Figure 17:
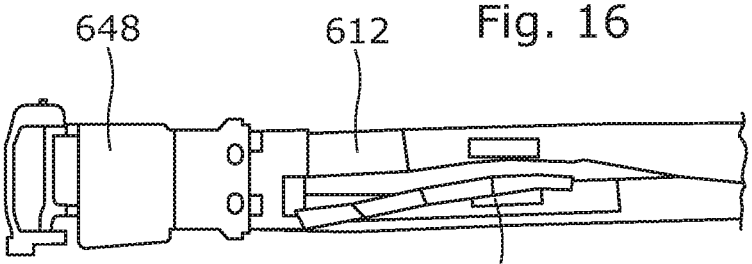
FIG. 17 illustrates an example of a toner dam after removal, corresponding to FIGS. 14-16.

FIGS. 15 to 17 are further examples of the principle of FIG. 14. FIG. 15 illustrates a cross sectional top view of an example cartridge 601 including the toner dam 612 and the knife 648. The toner dam 612 includes the carrier 605A that stores the authenticity verification code. The toner dam 612 includes the pull handle 646 to be pulled in a direction D to remove the toner dam 612. The cutting edge 650 of the knife 648 is disposed next to the carrier 605A in the pull direction so that the carrier 605A is cut when the toner dam 612 is pulled. FIG. 16 illustrates a cross sectional side view of the cartridge of FIG. 15. As illustrated, the knife 648 is disposed at the height of the carrier 605A to damage the carrier 605A when the toner dam 612 is pulled. FIG. 17 illustrates a pulled toner dam 612 including a pull handle 646 wherein the toner dam 612 and the carrier 605B have been cut through by the knife 648. Consequently the circuit storing the authenticity verification code has been permanently damaged and the authenticity verification code has been rendered unreadable.

Figure 18:
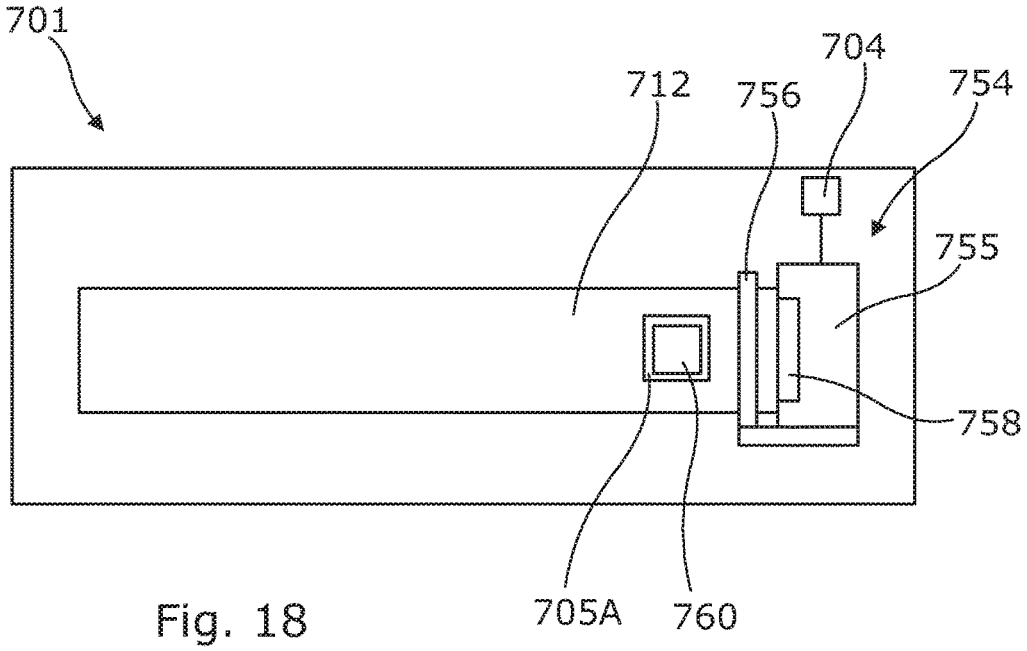
FIG. 18 illustrates a diagram of an example cartridge before installation.

FIG. 18 illustrates a cartridge 701 including a toner dam 712. The toner dam 712 includes a carrier 705A. The carrier 705A includes a first circuit 760 for contactless scanning such as an NFC circuit. The first circuit 760 stores an authenticity verification code. The cartridge 701 includes an automatic toner dam drive 754. The toner dam drive 754 includes an electro motor 755. The toner dam drive 754 includes a winder 756, for example including an axle to wind the toner dam 712. The winder 756 is connected to an end of the toner dam 712. The electro motor 755 is to drive the winder 756 to pull and wind the toner dam 712 around the axle, therewith releasing the toner particles from the reservoir. In one example the toner dam drive 754 is activated by the printer, for example through a printer interconnect circuit 704 of the cartridge 701 or through. At installation of the cartridge 701 the printer instructs the toner dam drive 754 through the interconnect circuit 704.

The cartridge 701 includes an auto-destruct feature 713. The auto-destruct feature 713 includes a second circuit 758 that is to apply a voltage across the first circuit 760 to damage the first circuit 760, therewith altering the authenticity verification code on the first circuit 760. In one example, the second circuit 758 is connected to electric circuitry of the toner dam drive 754. For example the second circuit 758 utilizes the same current source as the electromotor 755. For example the second circuit 758 includes at least one electrode. In another example the second circuit 758 is connected to another motor or current source of the cartridge 701.

Figure 19:
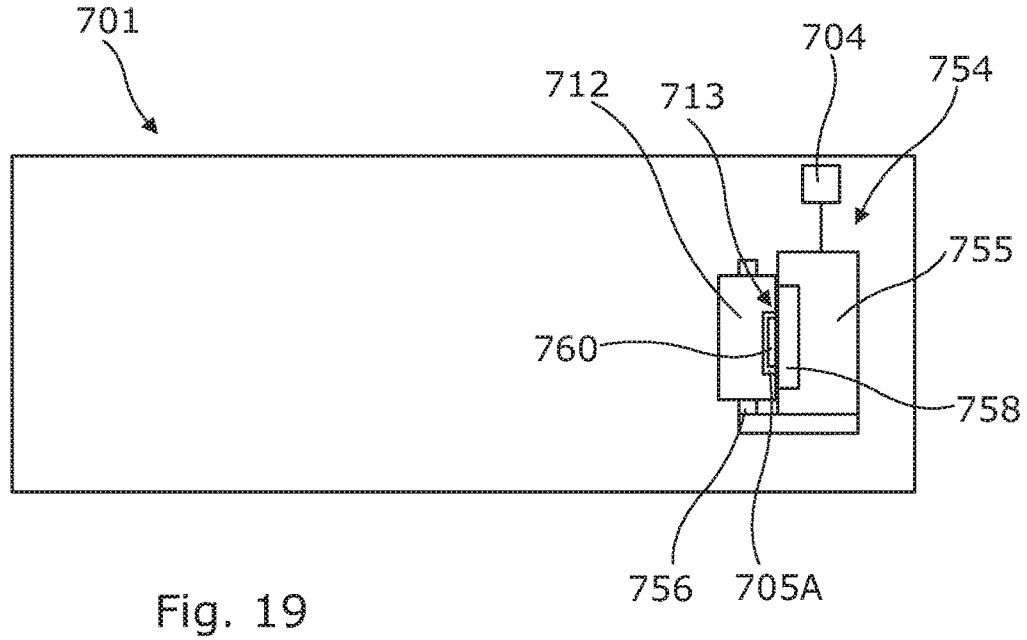
FIG. 19 illustrates a diagram of the example cartridge of FIG. 18 after installation.

FIG. 19 illustrates the cartridge 701 of FIG. 18 wherein the toner dam 712 is wound about the winder 756. As illustrated in FIG. 19, the at least one electrode is to engage the first circuit 760 when the toner dam 712 is wound, to apply a voltage across the first circuit 760, rendering the authenticity verification code unreadable by a third party scanning device. The amount of the voltage across the first circuit 760 can be enough to permanently damages the first circuit 760, or at least the authenticity verification code stored thereon.

In another example the second circuit 758 is to apply a magnetic field to the first circuit 758, in that way damaging the first circuit 760 rendering the authenticity verification code unreadable. For example the second circuit 758 includes a coil to produce the magnetic field. For example the second circuit 758 is to extend close to the first circuit 760, to damage the authenticity verification code without touching the first circuit 760.

The different example authenticity verification codes mentioned in this disclosure can be configured according to any suitable contactless or proximity machine reading standard including but not limited to one or any combination of NFC (e.g. ISO/IEC 14443, ISO/IEC 18092, ISO/IEC 21481, ECMA-340, ECMA-352), RFID (e.g. ISO/IEC 14443, ISO/IEC 18000, ISO/IEC 15693, ISO/IEC 18092, ISO/IEC 21481), proximity card reading (e.g. ISO/IEC 14443, ISO/IEC 15693), bar coding (e.g. ISO/IEC 15416, ISO/IEC 15415), QR coding (e.g. ISO/IEC 18004:2000, ISO/IEC 18004:2006) and other contactless code reading technologies.

The invention claimed is:

1. A cartridge to connect to a host device, the cartridge comprising:

an interconnect circuit to communicate with a host device;

a carrier other than the interconnect circuit to carry an authenticity verification code that is to be read in a contactless manner by a scan device other than the host device; and an auto-destruct feature to, after installation of the cartridge into the host device, render the authenticity verification code unreadable, wherein:

the cartridge comprises a housing that comprises a reservoir, toner dam, intermediate chamber, and a toner transfer assembly that define a toner travel path within the cartridge along which toner travels through the cartridge; and the carrier is disposed along the toner travel path within the cartridge.

2. The cartridge of claim 1, wherein the carrier is disposed so that toner particles conceal the authenticity verification code as the toner moves through the toner travel path after installation of the cartridge within the host device.

3. The cartridge of claim 1, further comprising an adhesive provided on the carrier to adhere toner particles to the authenticity verification code.

4. The cartridge of claim 1, further comprising a label provided on the carrier to absorb toner particles to conceal the authenticity verification code.

5. The cartridge of claim 1, wherein the carrier is at least partly moved to clear the toner travel path such that toner may move through the toner travel path.

6. The cartridge of claim 1, wherein:

the carrier is part of a toner dam to be pulled after installation for releasing toner, and the auto-destruct feature is to damage the authenticity verification code when the toner dam is moved.

7. The cartridge of claim 6, wherein:

the carrier comprises a contactless communication circuit storing the authenticity verification code, and the auto-destruct feature comprises a second circuit to render the code unreadable after installation.

8. The cartridge of claim 1, wherein the carrier is disposed downstream of the toner dam.

9. The cartridge of claim 1, wherein the carrier is disposed within a housing of the cartridge which housing includes a reservoir, to be scanned from the outside of the housing.

10. The cartridge of claim 9, wherein the housing comprises a window for detecting the authenticity verification code from the outside of the cartridge through the window.

11. A toner packaging assembly comprising:

a cartridge to connect to a host device, the cartridge comprising:

an interconnect circuit to communicate with a host device;

a carrier other than the interconnect circuit to carry an authenticity verification code that is to be read in a contactless manner by a scan device other than the host device; and an auto-destruct feature to, after installation of the cartridge into the host device, render the authenticity verification code unreadable; and a packaging at least partly surrounding the cartridge, the packaging comprising a window, the authenticity verification code being provided on the outside of the cartridge near the window so that the authenticity verification code is visible from the outside of the packaging through the window.

12. The assembly of claim 11, wherein the authenticity verification code is stored on a contactless communication circuit.

13. A toner cartridge comprising:

a carrier for contactless data communication to carry an authenticity verification code to be read by a scan device other than a host device; and an auto-destruct feature to, after installation of the cartridge into the host device, damage the authenticity verification code, wherein:

the cartridge comprises a housing that comprises a reservoir, toner dam, intermediate chamber, and a toner transfer assembly that define a toner travel path within the cartridge along which toner travels through the cartridge; and the carrier is disposed along the toner travel path within the cartridge.

* * * * *